US008531171B1

(12) United States Patent
Sutardja et al.

(10) Patent No.: US 8,531,171 B1
(45) Date of Patent: Sep. 10, 2013

(54) LOW POWER AND HIGH ACCURACY BAND GAP VOLTAGE CIRCUIT

(75) Inventors: Sehat Sutardja, Los Altos Hills, CA (US); Jiancheng Zhang, Los Altos Hills, CA (US)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 13/245,489

(22) Filed: Sep. 26, 2011

Related U.S. Application Data

(63) Continuation of application No. 12/879,033, filed on Sep. 10, 2010, now Pat. No. 8,026,710, which is a continuation of application No. 12/546,298, filed on Aug. 24, 2009, now Pat. No. 7,795,857, which is a continuation of application No. 11/334,030, filed on Jan. 18, 2006, now Pat. No. 7,579,822, which is a continuation of application No. 10/926,185, filed on Aug. 25, 2004, now Pat. No. 7,023,194, which is a continuation of application No. 10/413,927, filed on Apr. 15, 2003, now Pat. No. 6,844,711.

(51) Int. Cl.
*G05F 3/16* (2006.01)

(52) U.S. Cl.
USPC ..... 323/314; 323/313; 323/316

(58) Field of Classification Search
USPC ..... 323/312–316, 272, 280, 299, 297, 323/296; 307/296, 297, 455, 355, 491; 327/356, 530–540
See application file for complete search history.

(56) References Cited

U.S. PATENT DOCUMENTS

| | | | | |
|---|---|---|---|---|
| 4,059,793 | A | | 11/1977 | Ahmed |
| 4,841,427 | A | | 6/1989 | Miyazaki et al. |
| 4,896,094 | A | | 1/1990 | Greaves et al. |
| 5,119,015 | A | | 6/1992 | Watanabe |
| 5,245,223 | A | * | 9/1993 | Lim et al. ..... 327/80 |
| 5,382,922 | A | * | 1/1995 | Gersbach et al. ..... 331/1 A |
| 5,532,918 | A | | 7/1996 | Mayrand et al. |
| 5,642,037 | A | | 6/1997 | Malherbe |
| 5,689,202 | A | * | 11/1997 | Ranson ..... 327/142 |
| 5,703,475 | A | | 12/1997 | Lee et al. |
| 5,852,360 | A | | 12/1998 | Levinson |
| 5,917,311 | A | | 6/1999 | Brokaw |
| 5,949,227 | A | | 9/1999 | Bujanos |
| 5,955,873 | A | | 9/1999 | Maccarrone et al. |
| 6,009,022 | A | | 12/1999 | Lee et al. |
| 6,060,874 | A | * | 5/2000 | Doorenbos ..... 323/316 |
| 6,091,285 | A | | 7/2000 | Fujiwara |
| 6,124,704 | A | | 9/2000 | Annema |
| 6,150,871 | A | | 11/2000 | Yee |

(Continued)

FOREIGN PATENT DOCUMENTS

GB 2218544 A 11/1989

*Primary Examiner* — Rajnikant Patel

(57) ABSTRACT

A circuit including a first circuit, a second circuit, and a calibration circuit. The first circuit is configured to generate a first reference voltage potential. The second circuit is configured to generate a second reference voltage potential based on a calibration signal. The calibration circuit is configured to generate the calibration signal, to adjust the second reference voltage potential, based on the first reference voltage potential and the second reference voltage potential. The calibration circuit includes a comparing circuit configured to compare the first reference voltage potential and the second reference voltage potential, and a counter configured to increment a counter value based on the comparison of the first reference voltage potential and the second reference voltage potential and generate the calibration signal based on the counter value.

18 Claims, 9 Drawing Sheets

(56) References Cited

U.S. PATENT DOCUMENTS

| | | | | |
|---|---|---|---|---|
| 6,204,653 | B1 | 3/2001 | Wouters et al. | |
| 6,232,828 | B1 | 5/2001 | Smith et al. | |
| 6,335,614 | B1 | 1/2002 | Ganti | |
| 6,346,802 | B2 | 2/2002 | Lasalandra et al. | |
| 6,441,595 | B1 | 8/2002 | Pelissier et al. | |
| 6,590,372 | B1 | 7/2003 | Wiles | |
| 6,642,699 | B1 | 11/2003 | Gregoire, Jr. | |
| 6,710,586 | B2 | 3/2004 | Yamamoto | |
| 6,765,431 | B1 | 7/2004 | Coady | |
| 6,844,711 | B1 | 1/2005 | Sutardja et al. | |
| 7,023,194 | B1 | 4/2006 | Sutardja et al. | |
| 7,579,822 | B1 | 8/2009 | Sutardja et al. | |
| 7,795,857 | B1 * | 9/2010 | Sutardja et al. | 323/314 |

* cited by examiner

LOW POWER AND HIGH ACCURACY BAND GAP VOLTAGE CIRCUIT

CROSS-REFERENCE TO RELATED APPLICATIONS

This present disclosure is a continuation of U.S. application Ser. No. 12/879,033, filed on Sep. 10, 2010, which is a continuation of U.S. patent application Ser. No. 12/546,298 (now U.S. Pat. No. 7,795,857), filed Aug. 24, 2009, which is a continuation of U.S. patent application Ser. No. 11/334,030 (now U.S. Pat. No. 7,579,822), filed Jan. 18, 2006, which is a continuation of U.S. patent application Ser. No. 10/926,185 (Now U.S. Pat. No. 7,023,194), filed Aug. 25, 2004, which is a continuation of U.S. patent application Ser. No. 10/413,927 (Now U.S. Pat. No. 6,844,711), filed Apr. 15, 2003.

FIELD OF THE INVENTION

The present invention relates to voltage reference circuits, and more particularly to band gap voltage reference circuits having high accuracy and low power consumption.

BACKGROUND OF THE INVENTION

Band gap (BG) voltage reference circuits provide a fixed voltage reference for integrated circuits. Referring now to FIG. 1, an exemplary BG circuit 10 is shown and includes transistors $Q_1$ and $Q_2$, resistances $R_1$, $R_2$, and $R_3$, a variable resistance $R_{var}$ and an amplifier A. Collectors and bases of the transistors $Q_1$ and $Q_2$ are connected to a potential such as ground. The resistance $R_3$ has one end that is connected to an emitter of the transistor $Q_1$ and another end (at potential $V_1$) that is connected to the resistance $R_1$ and an inverting input of the amplifier A. The resistance $R_1$ is connected between one end of the resistance $R_{var}$ and one end of the resistance $R_2$. Another end of the resistance $R_2$ (at potential $V_2$) is connected to the emitter of the transistor $Q_2$ and a non-inverting input of the amplifier A. An output of the amplifier A is connected to another end of the resistance $R_{var}$, which is at the BG voltage potential $V_{bg}$.

Junctions between the emitters and the bases of the transistors $Q_1$ and $Q_2$ operate as diodes. The emitter area of $Q_1$ is typically larger than the emitter area of $Q_2$, where K is a ratio of the emitter area of $Q_1$ divided by the emitter area of $Q_2$. Amplifier A forces the voltage potentials $V_1=V_2$. Since the resistances $R_1=R_2$, the current flowing into the transistor $Q_1$ is equal to the current flowing into the transistor $Q_2$. Therefore, $$\Delta V_{be}=|V_{be}(Q_2)|-|V_{be}(Q_1)|=V_T\ln(K)$$

$$V_{bg}=V(R_{var})+V(R_2)+|V_{be}(Q_2)|$$

$\Delta V_{be}$ is applied across the resistance $R_3$ to establish a proportional to absolute temperature (PTAT) voltage. The voltages $V(R_{var})$ and $V(R_2)$ have positive temperature coefficients. $|V_{be}(Q_2)|$ has a negative temperature coefficient. Therefore, $V_{bg}$ has a net temperature coefficient of approximately zero. The resistor $R_{var}$ is adjusted to change $V_{bg}$ and its temperature coefficient.

The accuracy of $V_{bg}$ is related to the emitter area ratio K and the emitter area. Generally as the emitter area and the emitter area ratio K increases, the accuracy of the BG circuit also increases. As used herein, the term accuracy is used to reflect the variations that occur due to process. Higher accuracy refers to increasing invariance to process. Lower accuracy refers to increasing variance to process.

While increasing accuracy, the power dissipation of the transistor also increases with the area of the emitter. Therefore, the increased precision of the BG circuit is accompanied by an increase in power dissipation. Therefore, circuit designers must tradeoff accuracy and power dissipation.

SUMMARY OF THE INVENTION

A band gap voltage reference circuit comprises a first band gap (BG) circuit that generates a first BG voltage potential. A second BG circuit includes a variable resistance and outputs a second BG voltage potential that is related to a value of said variable resistance. A calibration circuit communicates with said first and second BG circuits, adjusts said variable resistance based on said first BG voltage potential and said second BG voltage potential, and selectively shuts down said first BG circuit.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
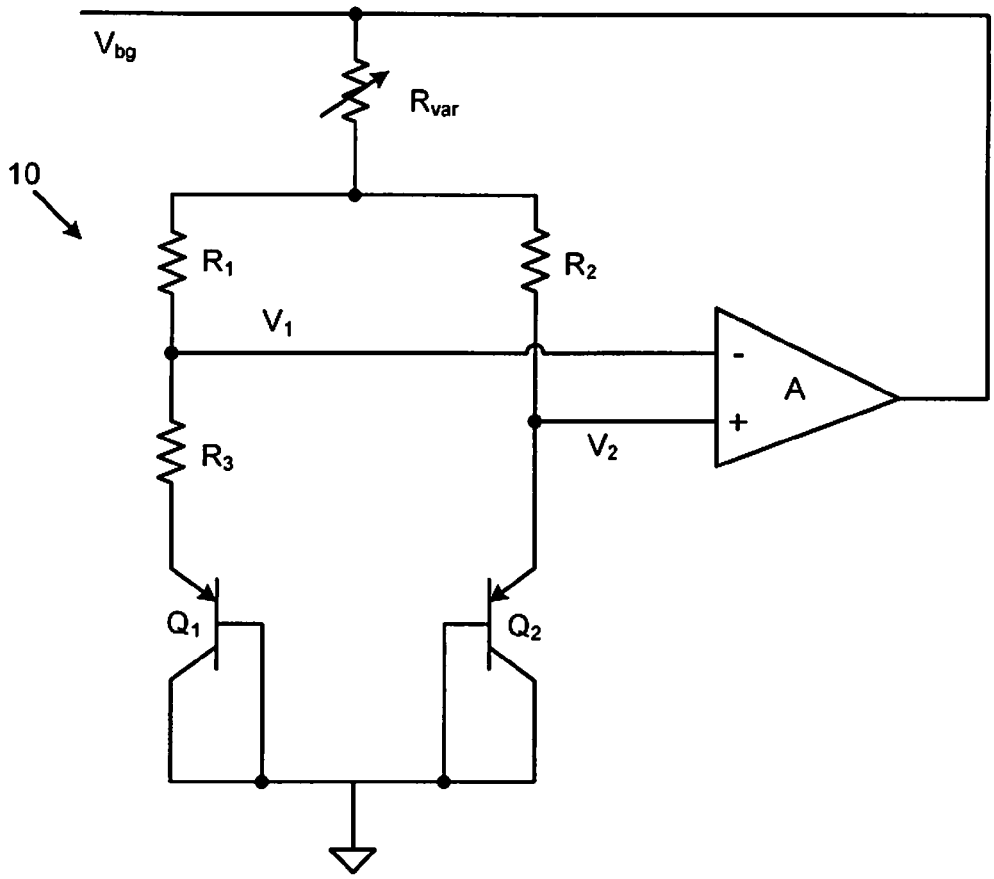
FIG. 1 illustrates an exemplary BG circuit according to the prior art.

The following description of the preferred embodiment(s) is merely exemplary in nature and is in no way intended to limit the invention, its application, or uses. For purposes of clarity, the same reference numbers will be used in the drawings to identify similar elements.

Figure 2:
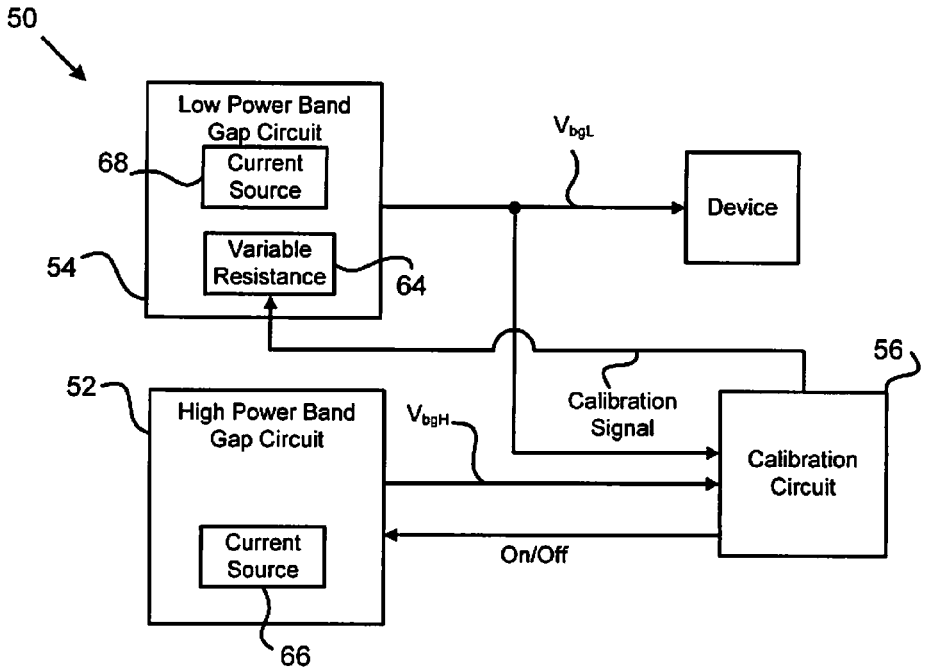
FIG. 2 is a functional block diagram of a BG circuit including low power and high power BG circuits according to the present invention.

Referring now to FIG. 2, a BG circuit 50 according to the present invention includes a high power BG circuit 52, a low power BG circuit 54, and a calibration circuit 56. As used herein, the terms high and low power are relative terms relating to the emitter area ratio K and the current density of the devices. The high power BG circuit has a larger emitter area and emitter area ratio, higher power dissipation and greater accuracy than the low power BG circuit. The degree to which the high and low power BG circuits differ will depend upon the accuracy and power consumption that is desired for a particular application. The high power BG circuit 52 provides a BG voltage reference potential $V_{bgH}$. The low power BG circuit 54 provides a BG voltage reference potential $V_{bgL}$.

The BG voltage potential $V_{bgL}$ and the BG voltage potential $V_{bgH}$ are input to the calibration circuit 56. The calibration circuit 56 compares the BG voltage potential $V_{bgL}$ to the BG voltage potential $V_{bgH}$ and generates a calibration signal. The calibration signal 62 is fed back to the low power BG circuit 54 to adjust the BG voltage potential $V_{bgL}$. In other words, the higher accuracy of the BG voltage potential $V_{bgH}$ is used to increase the accuracy of the BG voltage potential $V_{bgL}$.

In one embodiment, the calibration signal is used to adjust a variable resistance 64, which alters the BG voltage potential $V_{bgL}$, although other methods may be used. When the BG voltage potential $V_{bgL}$ and the BG voltage potential $V_{bgH}$ are approximately equal, the calibration circuit 56 turns the high power BG circuit 52 off to reduce power consumption.

In general, the current density for bipolar transistors in the high power and low power BG circuits 52 and 54, respectively, is approximately the same. The emitter area ratio of the bias current level for the high power and low power BG circuits 52 and 54 is approximately equal to the emitter area ratio of the emitter areas for the high power and low power BG circuits 52 and 54. For example, the ratio can be a factor of 4 or larger. Therefore, the high power BG circuit 52 uses bipolar transistors having larger emitter areas that are biased at higher current levels than the low power BG circuit 54. As a result, the high power BG circuit 52 provides the BG voltage reference $V_{bgH}$ that is generally more accurate than the BG voltage potential $V_{bgL}$ that is provided by the low power BG circuit 54.

Figure 3A:
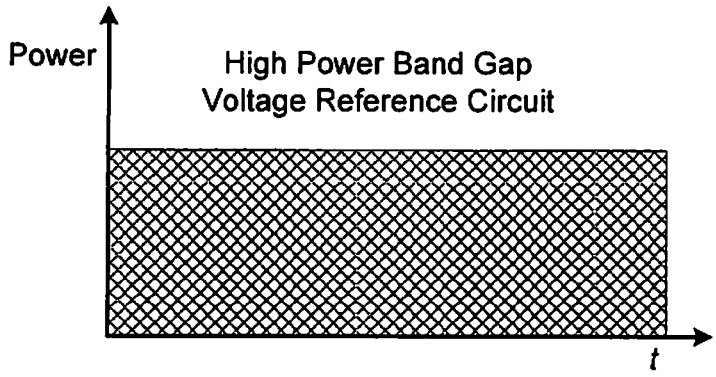
FIG. 3A Prior Art
FIG. 3A illustrates power consumption of a high power BG circuit according to the prior art.
Figure 3B:
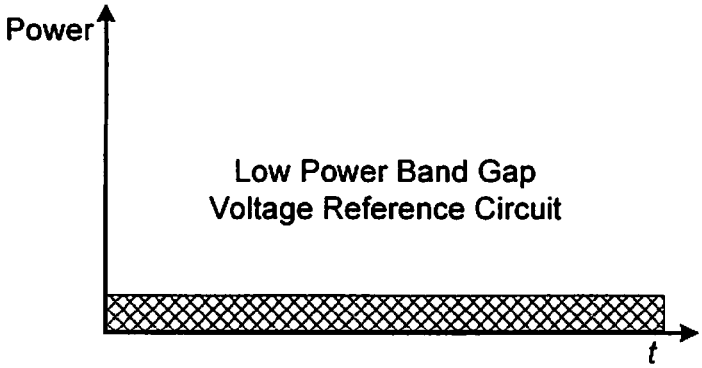
FIG. 3B Prior Art
FIG. 3B illustrates the power consumption of a low power BG circuit according to the prior art.

Referring now to FIG. 3A, power consumption of a high power BG circuit according to the prior art is shown. The high power BG circuit is biased by a higher current level. For example, a bias current level of 60 μA is output to the high power BG circuit. Conversely, a low power 13G circuit is biased by a lower current level and has lower power dissipation as shown in FIG. 3B. For example, a bias current level of 10 μA may be used.

Figure 3C:
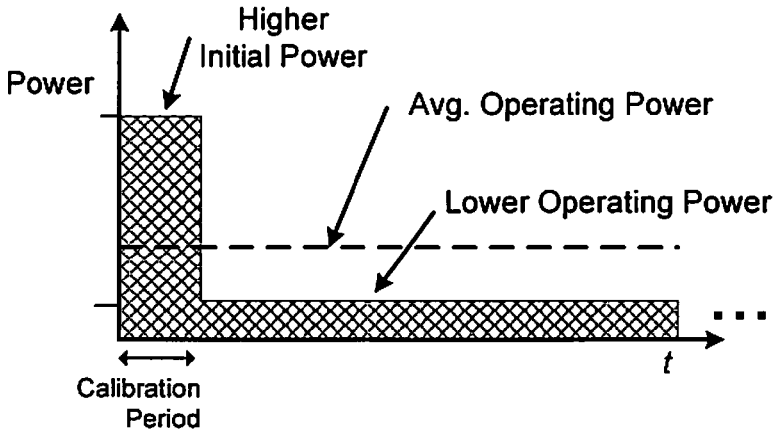
FIG. 3C illustrates the power consumption of a BG circuit with power on calibration of the low power BG circuit according to the present invention.

The power consumption of the BG circuit 50 of FIG. 2 is shown in FIG. 3C. Initially, the high power BG circuit 52 is biased by the higher current level. The low power BG circuit 54 is biased by the lower current level. This results in a higher initial power consumption. After the calibration is completed, however, the calibration circuit 56 shuts off the high power BG circuit 52. This is represented by the reduction in power consumption at the end of the calibration period in FIG. 3C. With the high power BG circuit 52 shut off, only the low power BG circuit 54 continues to consume power. As a result, the average power consumption is reduced.

Figure 3D:
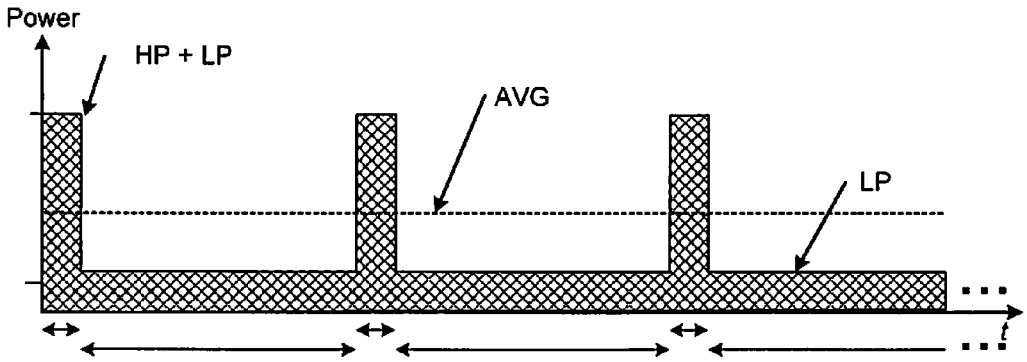
FIG. 3D illustrates the power consumption of a BG circuit with periodic calibration of the low power BG circuit according to the present invention.
Figure 3E:
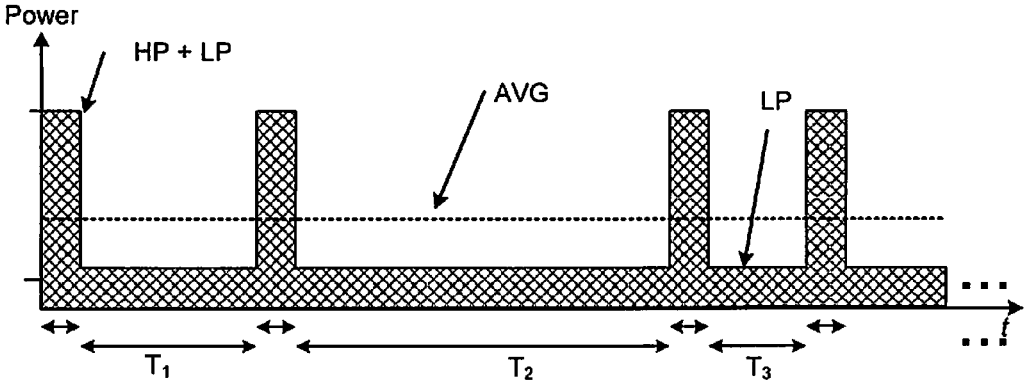
FIG. 3E illustrates the power consumption of a BG circuit with non-periodic calibration of the low power BG circuit according to the present invention.

Referring now to FIG. 3D, periodic calibration can also be performed. The calibration of the BG voltage potential $V_{bgL}$ using the BG voltage potential $V_{bgH}$ is performed after a predetermined period. Referring now to FIG. 3E, calibration can also be performed on a non-periodic basis. For example, the calibration can be performed at power on and when a predetermined event occurs. One example event could be a detected change in the BG voltage potential $V_{bgL}$. Degradation in performance of the device could also be a basis for non-periodic calibration. As another example, calibration can also occur when the operating temperature changes. Still other types of events are contemplated.

Figure 4:
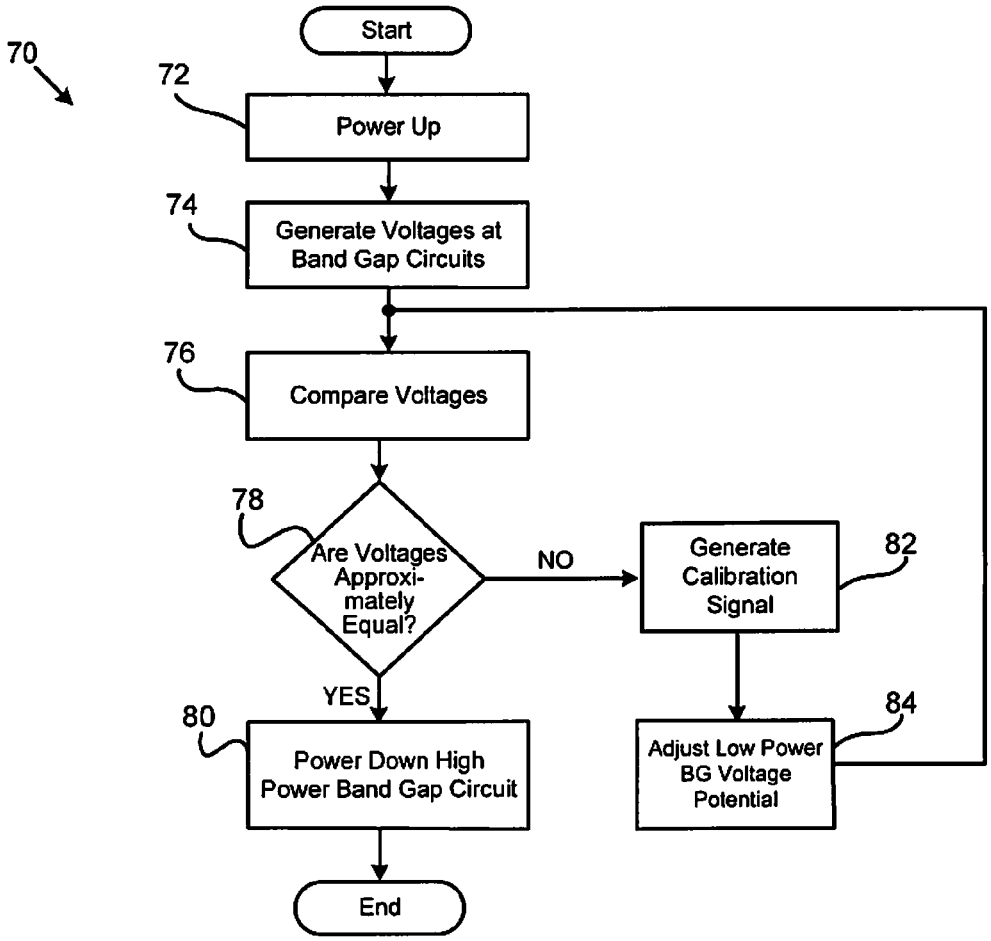
FIG. 4 is a flow diagram illustrating steps that are performed by a calibration circuit according to the present invention.

Referring now to FIG. 4, steps 70 for calibrating the low power BG circuit in FIG. 2 are shown. In step 72, both BG circuits 52 and 54 receive power at the beginning of calibration. Calibration may occur at an initial power up 72, at regular intervals, after specific events, or in any other circumstances. The foregoing description will describe calibration at start-up. However, skilled artisans will appreciate that the present invention is not limited to start-up.

After power up in step 72, the high power and low power BG circuits 52 and 54 generate the BG voltage potential $V_{bgH}$ and the BG voltage potential $V_{bgL}$, respectively, in step 74. The calibration circuit 56 compares the BG voltage potential $V_{bgH}$ to the BG voltage potential $V_{bgL}$ in step 76. In step 78, the calibration circuit 56 determines whether the BG voltage potential $V_{bgL}$ is within a predetermined threshold of the BG voltage potential $V_{bgH}$. If step 78 is true, the high power BG circuit 52 is powered down in step 80.

If the BG voltage potential $V_{bgL}$ is not within the predetermined threshold, the calibration circuit 56 generates a calibration signal in step 82. The low power BG circuit 54 receives the calibration signal in step 84 and adjusts the BG voltage potential $V_{bgL}$ based on the calibration signal. If the adjustment brings the BG voltage potential $V_{bgL}$ within the predetermined threshold, the high power BG circuit 52 powers down in step 80. Otherwise, the calibration 70 continues with steps 82 and 84.

Figure 5:
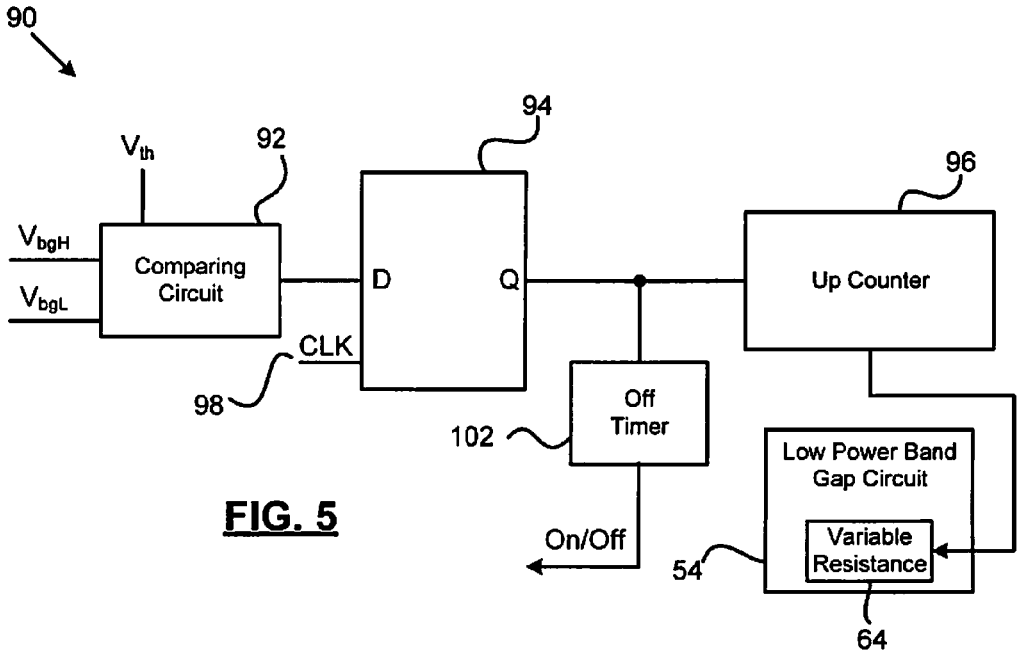
FIG. 5 illustrates an exemplary calibration circuit according to the present invention.

Referring now to FIG. 5, an exemplary calibration circuit 90 includes a comparing circuit 92, a D-type latch 94, and a counter 96. The comparing circuit 92 receives the BG voltage potential $V_{bgH}$ from the high power BG circuit 52. The comparing circuit 92 also receives the BG voltage potential $V_{bgL}$ from the low power BG circuit 54. The comparing circuit 92 determines whether the BG voltage potential $V_{bgL}$ is within a predetermined threshold $V_{th}$ of the BG voltage potential $V_{bgH}$.

In other words, the comparing circuit 92 determines whether $V_{bgH}+V_{th}>V_{bgL}>V_{bgH}-V_{th}$. For example, the threshold $V_{th}$ may be 2 mV or any other threshold. If the BG voltage potential $V_{bgL}$ is not within the threshold $V_{th}$ of the BG voltage potential $V_{bgH}$, the output of the comparing circuit 92 is a first state. If the BG voltage potential $V_{bgL}$ is within the threshold $V_{th}$ of the BG voltage potential $V_{bgH}$, the output of the comparing circuit 92 is a second state. Alternatively, a simple comparison between $V_{bgH}$ and $V_{bgL}$ may be used without the threshold $V_{th}$.

The D latch 94 receives the output from the comparing circuit 92. An output of the D latch 94 is determined by the output of the comparing circuit 92. The output of the D latch 94 is generated periodically based on a clock signal 98. If the D latch 94 receives an output of the first state from the comparing circuit 92, the D latch outputs a digital "1" at an interval determined by the clock signal 98. Conversely, if the D latch receives an output of the second state from the comparing circuit 92, the D latch outputs a digital "0" at the interval determined by the clock signal 98.

The counter 96 receives the digital "1" or "0" from the D latch. The counter 96 will receive the signal periodically as determined by the clock signal 98. The value stored by the counter 96 determines the value of a variable resistance 64 in the low power BG circuit 54. If the counter 96 receives a digital "1" from the D latch, the counter 96 increments the stored value, which increases the value of the variable resistance 64. If the counter 96 receives a digital "0", the stored value does not change.

Because the current source 66 of the BG circuit 54 is constant, adjusting the value of the variable resistance 64 also adjusts the value of the BG voltage potential $V_{bgL}$. If the BG voltage potential $V_{bgL}$ is less than the BG voltage potential $V_{bgH}$, the value of the variable resistance 64 is adjusted, thereby adjusting the BG voltage potential $V_{bgL}$.

A default value that is stored by the counter 96 ensures that the BG voltage potential $V_{bgL}$ is lower than the BG voltage potential $V_{bgH}$ at power up. Because the counter 96 is only able to increment in a positive direction, the calibration circuit 90 increases the BG voltage potential $V_{bgL}$ until it is approximately equal to the BG voltage potential $V_{bgH}$.

Calibration continues until the calibration circuit 90 determines that the BG voltage potential $V_{bgL}$ is equal to or approximately equal to the BG voltage potential $V_{bgH}$. Then, the calibration circuit 90 turns the high power BG circuit 52 off. For example, a power off timer 102 may be used to determine that the D latch 94 failed to output a digital "1" for a predetermined period. Additionally, the power off timer 102 prevents the high power BG circuit 52 from being powered off for an initial period after the power up. This ensures that the BG circuits 52 and 54 have an opportunity to stabilize.

Figure 6A:
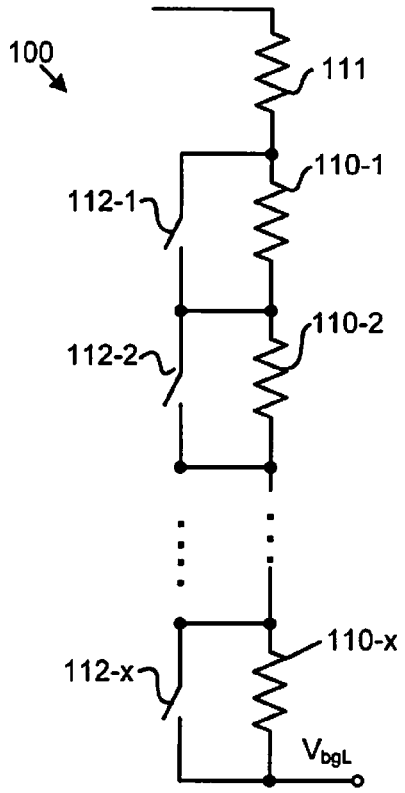
FIGS. 6A and 6B illustrate exemplary variable resistance circuits according to the present invention.
Figure 6B:
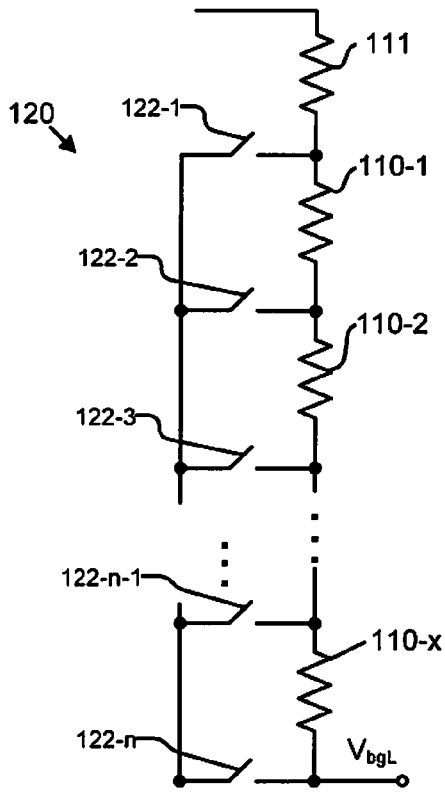

Referring now to FIGS. 6A and 6B, exemplary variable resistances are shown. In FIG. 6A, the variable resistance 100 includes multiple resistive elements 110-1, 110-2, . . . , and **110-*x* in series with a base resistive element 111. The resistive elements 110 and 111 can be resistors, variable resistances, or any other type of resistive circuit. The resistive elements 110 are added and/or removed using parallel switches 112-1, 112-2, . . . , and 112-*x*. In one embodiment, the switches 112 are transistor circuits. An output of the counter 96 in FIG. 5 is used to control the switches 112**.

FIG. 6B shows another exemplary embodiment of a variable resistance 120, which includes the multiple resistive elements 110-1, 110-2, . . . , and **110-*x* in series with the base resistive element 111. The resistive elements 110 are added and/or removed using switches 122-1,122-2, . . . , and 122-*x***. Skilled artisans will appreciate that any other device that provides a variable resistance can be used.

There are numerous methods for implementing the calibration circuit 90. For example, a down counter may be substituted for the up counter 96. In this embodiment, the calibration circuit 90 would adjust the second BG voltage reference potential $V_{bgL}$ downward from an initial value that is greater than the first BG voltage reference potential $V_{bgH}$.

Figure 7:
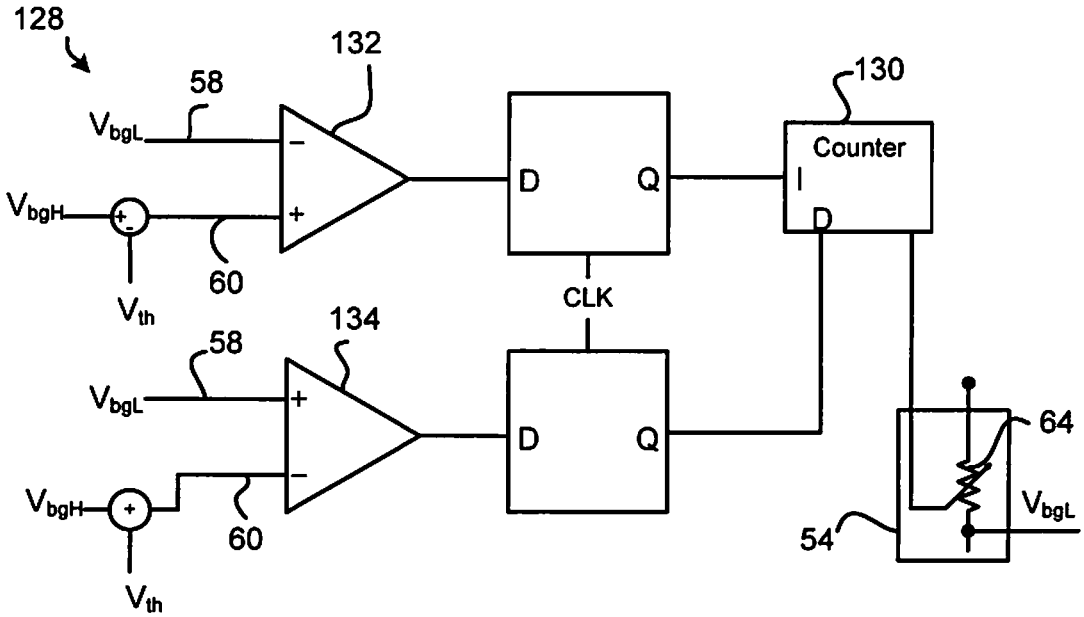
FIG. 7 illustrates a calibration circuit incorporating an up/down counter according to the present invention.

Referring now to FIG. 7, a calibration circuit 128 that includes an up/down counter 130 is shown. A first comparator 132 outputs a digital "1" if the BG voltage potential $V_{bgL}$ is less than BG voltage potential $V_{bgH}$ minus $V_{th}$. A second comparator 134 outputs a digital "1" if the BG voltage potential $V_{bgL}$ is greater than the BG voltage potential $V_{bgH}$ plus $V_{th}$. Therefore, if the BG voltage potential $V_{bgL}$ is too low, as determined by the threshold $V_{th}$, the counter 130 is incremented. If the BG voltage potential $V_{bgL}$ is too high, as determined by the threshold $V_{th}$, the counter 130 is decremented. Once the BG voltage potential $V_{bgL}$ stabilizes, the value of the counter 130 will no longer increment or decrement.

Figure 8A:
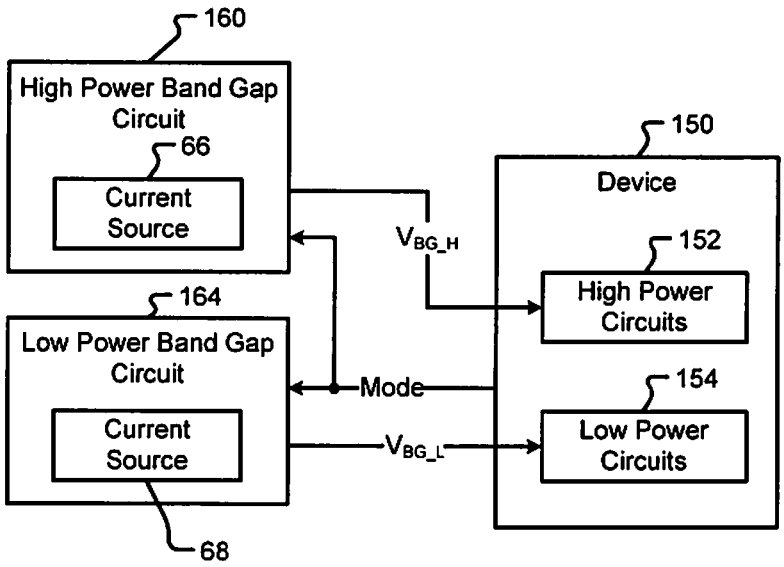
FIGS. 8A and 8B are functional block diagrams of a device including high power and low power circuits that are selectively powered by high power and low power BG circuits.

Referring now to FIG. 8A, a device 150 includes high power circuits 152 and low power circuits 154. When operating in the high power mode, the device 150 requires high power to operate the high power circuits 152. When operating in the low power mode, the device 150 requires lower power to operate the low power circuits 154. The low power circuits 154 may also be powered in both the high power and low power modes.

Figure 8B:
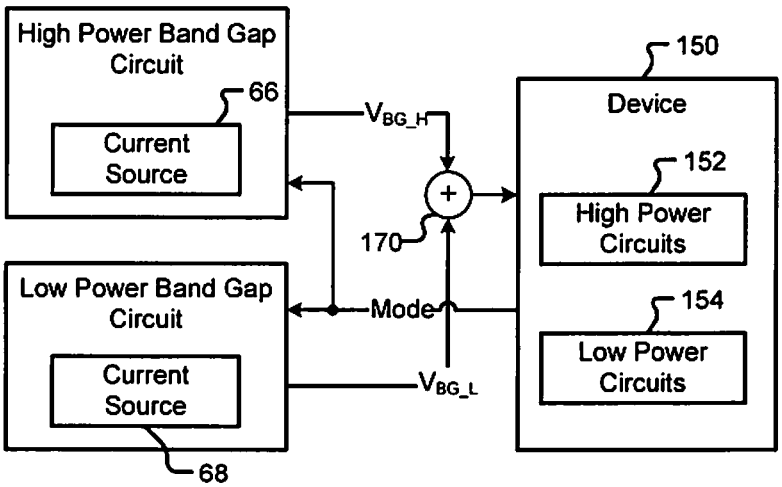

For example, the device 150 may be a transceiver that has a powered up mode and a sleep or standby mode. The device 150 generates a mode select signal that is used to turn on/off a high power BG circuit 160 and/or a low power BG circuit 164 as needed. In FIG. 8B, the BG voltage potential $V_{bgH}$ and the BG voltage potential $V_{bgL}$ are summed by a summer 170 before being input to the device 150. The device 150, in turn, distributes the supplied power to the high power circuits 152 and the low power circuits 154 as needed.

Figure 9:
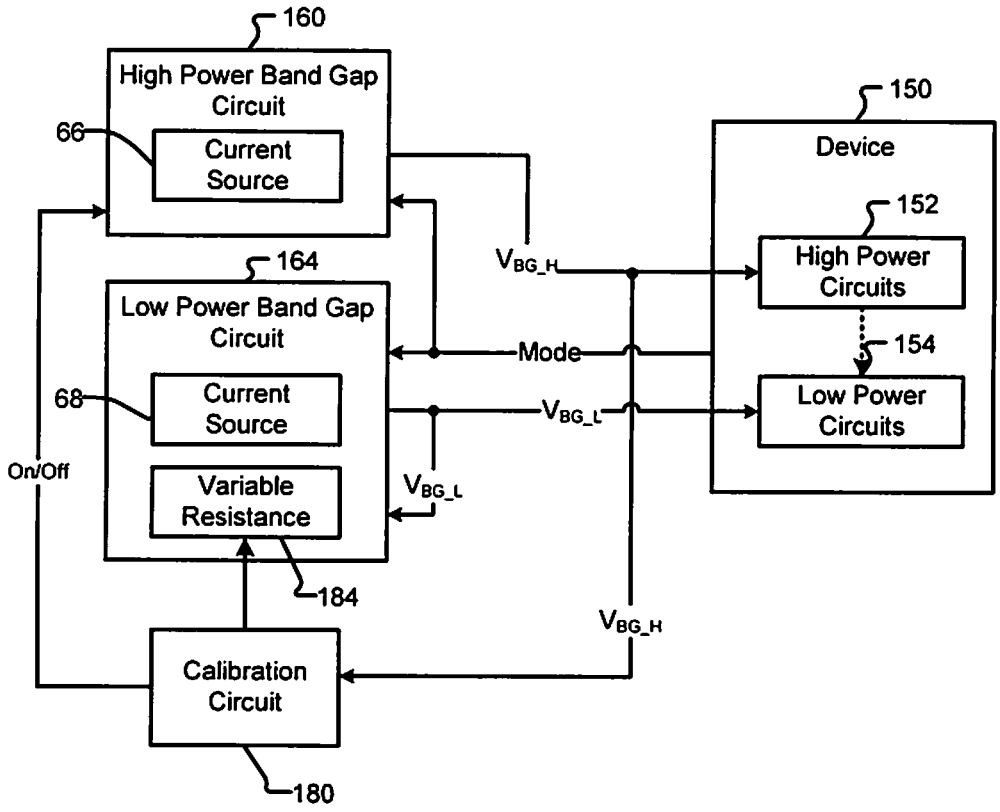
FIG. 9 is a functional block diagram of the circuits in FIG. 8A with a calibration circuit.

Referring now to FIG. 9, a calibration circuit 180 is used to calibrate the low power BG circuit 164. The low power BG circuit 164 includes a variable resistance 184 that is adjusted by the calibration circuit 180 as was described above. As can be appreciated, the circuit in FIG. 9 can also include a summer 170 as shown in FIG. 8B.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A circuit, comprising:

a first circuit configured to generate a first reference voltage potential;

a second circuit configured to generate a second reference voltage potential based on a calibration signal; and a calibration circuit configured to generate the calibration signal, to adjust the second reference voltage potential, based on the first reference voltage potential and the second reference voltage potential, wherein the calibration circuit comprises a comparing circuit configured to compare the first reference voltage potential to the second reference voltage potential, and a counter configured to increment a value of a counter based on the comparison of the first reference voltage potential to the second reference voltage potential, and ii) generate the calibration signal based on the value of the counter.

2. The circuit claim 1, wherein the second circuit includes a resistance that is adjustable based on the calibration signal, and wherein the second reference voltage potential is based on the resistance.

3. The circuit of claim 2, wherein the value of the counter corresponds to a desired value of the resistance.

4. The circuit of claim 2, wherein the resistance includes a plurality of individually selectable resistive elements.

5. The circuit of claim 1, wherein the first circuit is associated with a first emitter area ratio, and the second circuit is associated with a second emitter area ratio, and wherein the first emitter area ratio is greater than the second emitter area ratio.

6. The circuit of claim 1, wherein the counter stores a default value when the circuit is powered on, and wherein the default value causes the second reference voltage potential to be less than the first reference voltage potential.

7. The circuit of claim 1, wherein the calibration circuit further comprises a latch circuit figured to selectively increment the value of the counter based on the comparison until the second reference voltage potential is within a predetermined threshold of the first reference voltage potential.

8. The circuit of claim 1, wherein the calibration circuit is configured to shut down the first circuit in response to the second reference voltage potential being within a predetermined threshold of the first reference voltage potential.

9. The circuit of claim 8, wherein the calibration circuit includes a timer configured to prevent the first circuit from being shut down for a predetermined period after the circuit is powered on.

10. A method of operating a circuit, the method comprising:

generating a first reference voltage potential;

generating a second reference voltage potential based on a calibration signal; and generating the calibration signal, to adjust the second reference voltage potential, based on the first reference voltage potential and the second reference voltage potential, wherein generating the calibration signal comprises comparing the first reference voltage potential to the second reference voltage potential, incrementing a value of a counter based on the comparison of the first reference voltage potential to the second reference voltage potential, and generating the calibration signal based on the value of the counter.

11. The method claim 10, wherein generating the second reference voltage potential includes generating the second reference voltage potential based on a resistance that is adjustable based on the calibration signal.

12. The method of claim 11, wherein the value of the counter corresponds to a desired value of the resistance.

13. The method of claim 11, wherein the resistance includes a plurality of individually selectable resistive elements.

14. The method of claim 10, wherein the first reference voltage potential is associated with a first emitter area ratio, and the second reference voltage potential is associated with a second emitter area ratio, and wherein the first emitter area ratio is greater than the second emitter area ratio.

15. The method of claim 10, wherein the value of the counter corresponds to a default value when the circuit is powered on, and wherein the default value causes the second reference voltage potential to be less than the first reference voltage potential.

16. The method of claim 10, further comprising selectively incrementing the value of the counter based on the comparison until the second reference voltage potential is within a predetermined threshold of the first reference voltage potential.

17. The method of claim 10, further comprising shutting down the first reference voltage potential in response to the second reference voltage potential being within a predetermined threshold of the first reference voltage potential.

18. The method of claim 17, further comprising preventing the first reference voltage potential from being shut down for a predetermined period after the circuit is powered on.

* * * * *